US005855385A

United States Patent [19]

Hambsch

[11] Patent Number: 5,855,385

[45] Date of Patent: Jan. 5, 1999

[54] WHEELED BOARD APPARATUS HAVING PLATFORM WITH CONCAVE SIDECUTS

[76] Inventor: Stephen G. Hambsch, 35 Cove Rd., Old Greenwich, Conn. 06870

[21] Appl. No.: 717,632

[22] Filed: Sep. 23, 1996

[51] Int. Cl.[6] ..... A63C 17/04

[52] U.S. Cl. ..... 280/87.042; 280/842

[58] Field of Search ..... 280/842, 843, 280/11.2, 11.22, 11.27, 87.01, 87.041, 87.042; 301/5.23, 5.3

[56] References Cited

U.S. PATENT DOCUMENTS

| | | | |
|---|---|---|---|
| D. 244,706 | 6/1977 | Vela | D34/15 |
| 1,533,837 | 4/1925 | Douglas | 280/87.041 |
| 2,861,814 | 11/1958 | Rebhun | 280/243 |
| 3,379,454 | 4/1968 | Woodman | 280/87.042 |
| 3,399,904 | 9/1968 | Schinke | 280/87.042 |
| 3,827,706 | 8/1974 | Milliman | 280/842 |
| 3,856,321 | 12/1974 | Solymosi | 280/87.041 |
| 4,106,786 | 8/1978 | Talbott | 280/8 |
| 4,744,576 | 5/1988 | Scollan, Jr. | 280/87.042 |
| 4,887,824 | 12/1989 | Zatlin | 280/87.042 |
| 4,921,513 | 5/1990 | Parten | 280/87.042 |
| 5,096,225 | 3/1992 | Osawa | 280/842 |
| 5,125,687 | 6/1992 | Hwang | 280/842 |
| 5,169,165 | 12/1992 | Oates | 280/87.03 |
| 5,192,088 | 3/1993 | Yu | 280/11.27 |
| 5,303,940 | 4/1994 | Brandner | 280/11.27 |
| 5,409,265 | 4/1995 | Douglass | 280/843 |
| 5,553,874 | 9/1996 | Schouten et al. | 280/87.042 |
| 5,566,958 | 10/1996 | Sinelnikov et al. | 280/11.22 |
| 5,580,074 | 12/1996 | Moreno | 301/5.3 |
| 5,601,299 | 2/1997 | Yun et al. | 280/843 |
| 5,707,068 | 1/1998 | Bradfield | 280/87.042 |

FOREIGN PATENT DOCUMENTS

| | | | |
|---|---|---|---|
| 92/05845 | 4/1992 | WIPO | 280/843 |

*Primary Examiner*—Brian L. Johnson
*Assistant Examiner*—Frank Vanaman
*Attorney, Agent, or Firm*—Fitzpatrick, Cella, Harper & Scinto

[57] ABSTRACT

A wheeled board apparatus has a platform with first and second concave portions. At least two primary wheels are located along a central longitudinal axis, with at least three outrigger wheels located generally along each concave sidecut.

17 Claims, 2 Drawing Sheets

WHEELED BOARD APPARATUS HAVING PLATFORM WITH CONCAVE SIDECUTS

BACKGROUND OF THE INVENTION

1. Field of the Invention

The present invention relates to skateboard type devices for recreation and athletic training. More particularly, the present invention relates to wheeled devices which reproduce faithfully the sensation of using a snowboard, a mono ski or ski.

2. Brief Description of the Background Art

Recreation devices for gliding across various surfaces are well known. These devices include, for instance, water skis, inner tubes and the like for traversing water, and skis, snowboards, toboggans and the like for traversing snow. Lately, there has been a need to recreate these activities on dry land, specifically pavement or synthetic surfaces. Most notably, this need has resulted in the development of in-line skates to imitate ice skates, as well as the development of wheeled skis to imitate the movement of cross country skiing. However, there has not previously been a successful dry land imitation of the snowboard, monoski or downhill ski.

Previous attempts to create dry land monoskis have largely utilized skateboard technology. As is well known, skateboards utilize front and rear wheel assemblies (called "trucks") mounted on a substantially rigid elongate platform. The trucks each feature two wheels mounted with low friction bearings disposed on a metal axle housing. The axle housing is mounted on the underside of the platform fixed at a right angle to the longitudinal axis of the platform at a fixed distance therefrom. Although the axle housing is fixed at 90 degrees to the longitudinal axis of the platform, the axle housing is spring biased so that it is nominally disposed parallel to the closest lateral axis of the platform. However, under stress, the lateral plane of the platform of the skateboard is permitted to rotate about the centerpoint of the axle housing in order to permit turning.

In practice, skateboards do not successfully mimic the dynamics of snowboards or skis. That is, snowboards, skis and monoskis are one track devices that turn primarily by edging, whereas skateboards are of necessity two track devices that turn by steering. For this reason, they are not generally usable as warm weather training aids for snowboarding athletes, nor are they especially enjoyable for recreation.

Other dry land monoskis have been less successful. For instance, U.S. Pat. No. 5,125,687 relates to a rollerboard for road skiing. The rollerboard has large wheels mounted along the central longitudinal axis with an outrigger wheel disposed axially therefrom. As described in the patent, the front wheel along the longitudinal axis pivots for steering when the rollerboard is leaned onto one of the outrigger wheels. In this configuration, although the rollerboard travels in a straight line as a one track device, it functions when turning as a two track device.

U.S. Pat. No. 4,887,824 teaches another rollerboard having two skateboard trucks mounted along the central longitudinal axis of the platform. The platform provides inclined planes along the left and right sides of the longitudinal axis with a single truck pivotally mounted on each inclined plane as an outrigger. U.S. Pat. No. 4,744,576 teaches a similar rollerboard in which the trucks mounted along the central longitudinal axis are pivoting and the outrigger wheels are nonpivoting.

U.S. Pat. No. 3,827,706 provides wheeled skis having wheels pivotally mounted along the central longitudinal axis of a platform with nonpivoting outrigger wheels mounted along parallel longitudinal axes. As depicted therein, the wheels along the central longitudinal axis extend further beneath the platform so as to prevent the outrigger wheels from contacting the ground until the skis are banked for turning.

U.S. Pat. No. 5,409,265 teaches a skateboard having ball rollers mounted along the central longitudinal axis with smaller diameter ball rollers mounted along parallel longitudinal axes.

U.S. Pat. No. 4,106,786 teaches a board device particularly for use on nonpaved inclines. The device features a platform having a nonpivoting central wheel with outrigger skids. By shifting the operator's weight forward or rearward, the skids can contact the ground, maintaining a substantially level footing surface while braking the device.

SUMMARY OF THE INVENTION

It is an object of the invention to provide a wheeled board apparatus which is capable of accurately mimicking on dry land the sensation of skiing or snowboarding.

It is another object of the invention to provide a wheeled board apparatus which is capable of turning as a one track device.

These objects and others are attained by the present invention which provides a skateboard type apparatus which has sidecuts provided by concave portions along its side edges. Outrigger wheels are located along the concave portions so that the apparatus is capable of turning as a two track device in a learner mode and is also capable of turning as a one track device in a more advanced expert mode.

DETAILED DESCRIPTION OF THE INVENTION

Figure 1:
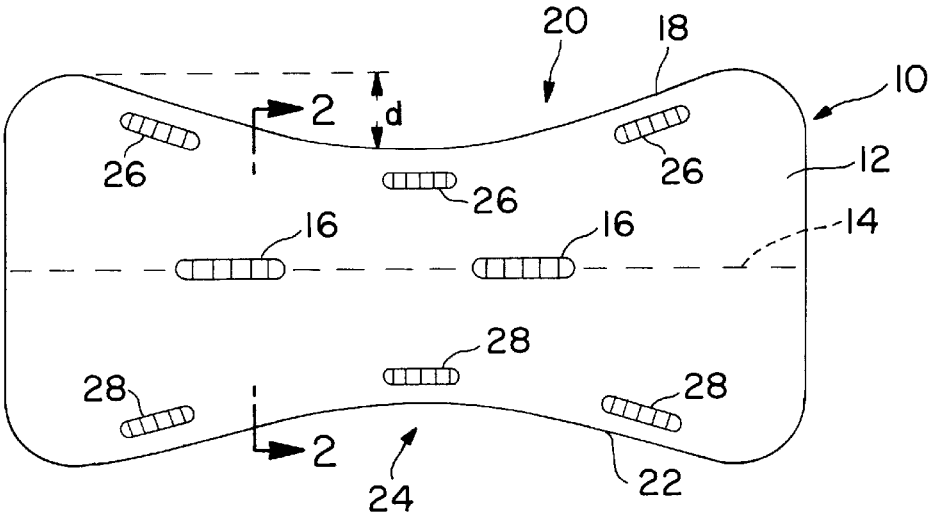
FIG. 1 is a bottom plan view of an embodiment of the present invention.
Figure 2A:
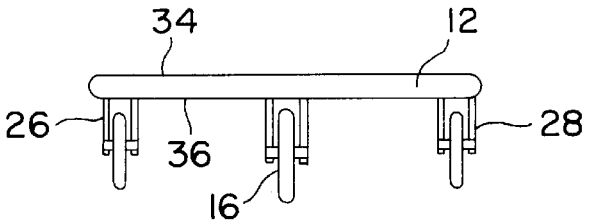
FIG. 2A is a cut-away front elevation view of the embodiment of FIG. 1 taken generally along the line 2—2.
Figure 2B:
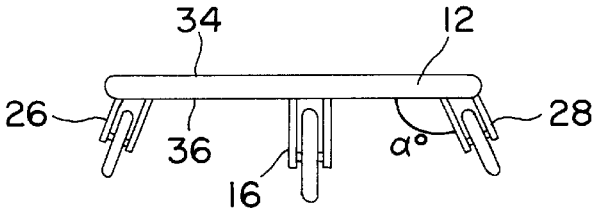
FIGS. 2B and 2C are cut-away front elevation views of other embodiments taken generally along the line 2—2 of FIG. 1.

Referring to FIGS. 1–4, the present invention provides a wheeled board apparatus 10 with a structural platform 12 having an upper surface 34 and a lower surface 36 (see particularly FIGS. 2A and 2B). Platform 12 is constructed of any conventional materials including, but not limited to: wood, fiberglass, mold injected or spun plastic and metal, such as aluminum. If wood is chosen, laminates may be particularly preferred to enhance strength and durability. Similarly, preferred fiberglass constructs include cores of disparate materials (not illustrated), such as balsa, in order to enhance rigidity and reduce weight.

Platform 12 features at least two primary wheels 16 with their rolling surfaces (e.g., their circumferences) located in line along the central longitudinal axis 14 of platform 12.

Primary wheels 16 are utilized when the wheeled board apparatus is operated in a straight line, as discussed below.

Side edges 18 and 22 along the length of platform 12 define concave portions 20 and 24. Desirably, concave portions 20 and 24 are symmetric about central longitudinal axis 14. As clearly depicted in FIG. 1, concave portions 20 and 24 define sidecut (d).

As is well understood, the size of sidecut (d) drastically affects the turning characteristics of wheeled board 10 since a larger sidecut (d) will of necessity provide wheeled board 10 with a smaller turning radius and thus, quicker responsiveness. Moreover, as will readily be understood, the size of sidecut (d) generally required to maintain optimum turning characteristics differs in a longer platform from that which is required for a shorter platform. Accordingly, the size of sidecut (d) may be selected as desired in order to provide a predetermined turning characteristic. However, sidecut (d) is generally at least ½ inch and, in typical embodiments, at least 1 inch. More preferably, sidecut (d) is from 1½ to 4½ inches.

Mounted along edges 18 and 22 are sets of outrigger wheels 26 and 28. Generally, at least three outrigger wheels are utilized along each edge 18 and 22. As shown clearly in FIG. 1, the rolling surfaces of adjacent outrigger wheels are not typically oriented in line with each other. Rather, the rolling surfaces of outrigger wheels 26 and 28 are oriented in an arcuate manner generally along the edges 18 and 22 respectively provided by concave sidecut portions 20 and 24.

Figure 2C:
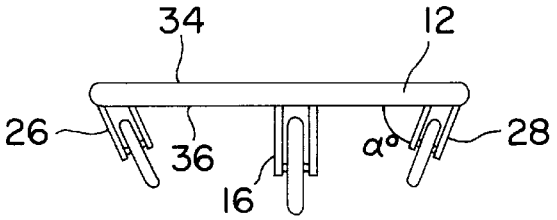

Outrigger wheels 26 and 28 may be disposed generally perpendicular to platform 12 as shown in FIG. 2A. Outrigger wheels 26 and 28 may also be disposed angled outwardly from platform 12 as shown in FIG. 2B, or disposed inwardly towards platform 12, as shown in FIG. 2C.

If outrigger wheels 26 and 28 are disposed angled outwardly from platform 12 as in FIG. 2B, angle ($\alpha$) may vary as desired. Typically, $90° < \alpha \leqq 135°$, desirably $90° < \alpha < 125°$. More desirably, $95° \leqq \alpha \leqq 110°$. Similarly, if outrigger wheels 26 and 28 are angled inwardly towards platform 12 as in FIG. 2C, angle ($\alpha$) also varies as desired. Typically, $90° > \alpha \geqq 45°$, desirably $90° > \alpha > 55°$. More desirably, $85° \geqq \alpha \geqq 70°$. Moreover, it is contemplated that in all embodiments, individual outrigger wheels may be mounted at different angles $\alpha$ to platform 12 in order to vary the turning characteristics of wheeled board apparatus 10 as desired.

Figure 3:
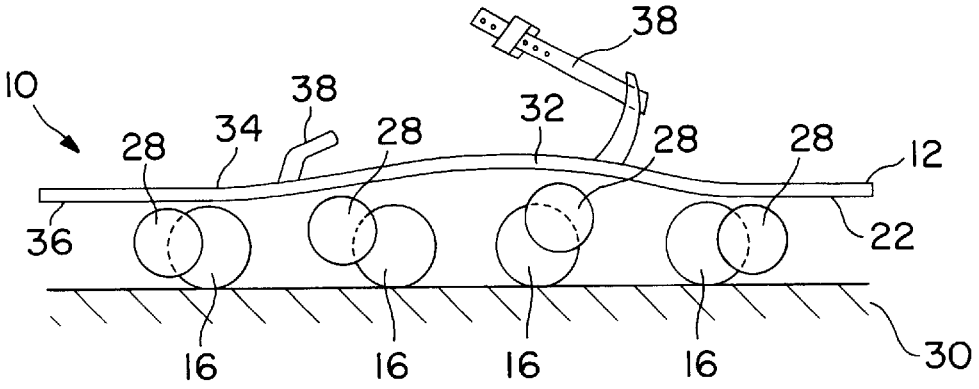
FIG. 3 is a side elevation view of another embodiment of the present invention.

As illustrated in FIG. 3, outrigger wheels 26 and 28 do not extend as far beneath the lower surface 36 of platform 12 as primary wheels 16. (This may be accomplished either by mounting primary wheels further from platform 12 than outrigger wheels or by utilizing primary wheels of greater diameter than the outrigger wheels.) Accordingly, outrigger wheels 26 and 28 do not generally contact the ground when dry land snowboard 10 is operated in a straight line. Rather, outrigger wheels are utilized for turning wheeled board apparatus 10 when the operator tilts platform 12 sufficiently for one set of outrigger wheels 26 (or 28) to contact the pavement 30.

Figure 4A:
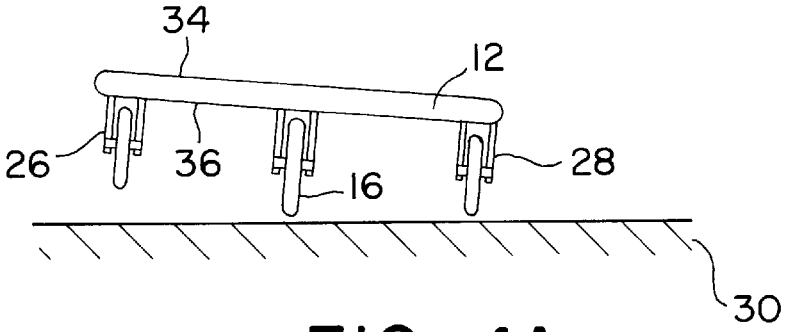
FIGS. 4A and 4B are front elevation views of the embodiment of FIG. 2A utilized in a two-track mode and in a one-track mode, respectively.
Figure 4B:
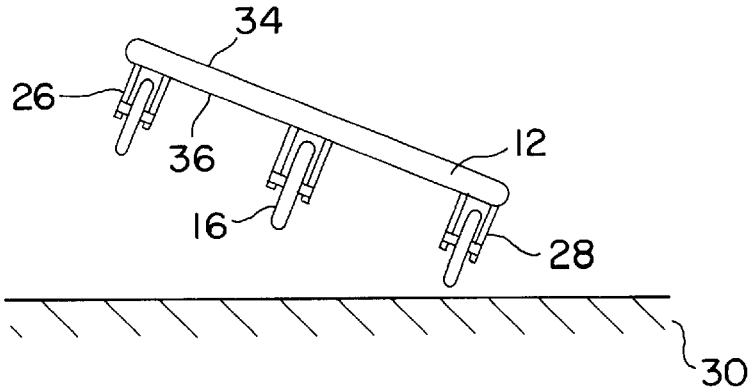

When outrigger wheels 26 (or 28) contact the pavement 30 in a minimum lean two-track mode ("learner" condition) shown in FIG. 4A, wheeled board apparatus 10 travels in a two track manner upon one set of outrigger wheels and primary wheels 16. Wheeled board apparatus 10 then turns in the direction of outrigger wheels 26 (or 28) as enabled by concave portion 20 (or 24). Additionally, when the operator continues to lean platform 12, primary wheels 16 leave pavement 30 and wheeled board apparatus 10 travels in a one-track mode ("expert" condition) shown in FIG. 4B, turning and traveling upon outrigger wheels 26 (or 28) exclusively. In this regard, it is preferable that primary wheels 16 be of a material that is less sticky (e.g., has a higher durometer rating) than outrigger wheels 26 and 28.

As will be readily understood by the foregoing, the nimbleness and quick response of wheeled board apparatus 10 (its "turnability") is determined, in part, by the size of sidecut (d). Additionally, the turnability of dry land snowboard 10 is affected by angle $\alpha$ defined by the disposition of outrigger wheels 26 and 28 from lower surface 36 of platform 12; wheeled board apparatus 10 will be more stable when outrigger wheels 26 and 28 are angled outwardly from platform 12 as illustrated in FIG. 2B, in contrast, wheeled board apparatus 10 will turn easier and quicker when outrigger wheels 26 and 28 define substantially right angles from platform 12.

In another preferred embodiment illustrated in FIG. 3, platform 12 provides convex load bearing area 32 on upper surface 34. Convex area 32 is desirably provided across the width of platform 12 extending perpendicularly from central longitudinal axis 14. Generally, materials and construction of platform 12 are selected so as to permit selective deformation of convex area 32 (depending upon operator weight and skill level) so as to vary the arc provided by concave portions 20 and 24 and thereby, sidecut (d).

Generally, upper surface 34 of platform 12 has a non-skid texture. Alteratively, it is contemplated by the inventor that wheeled board device will provide one or two conventional foot retention devices. Such foot retention devices include, but are not limited to, step-in ski binding-type systems, step-in bicycle pedal-type binding systems and strap-type retention systems 38 (FIG. 3). Such retention devices may be mounted as desired on platform 12, including in side-by-side, fore and aft, or staggered orientations, and may also be affixed to upper surface 34 rigidly or may be free to pivot on upper surface 34.

Although the present invention has been illustrated with reference to certain preferred embodiments, it will be appreciated that the present invention is not limited to the specifics set forth therein. Those skilled in the art readily will appreciate numerous variations and modifications within the spirit and scope of the present invention, and all such variations and modifications are intended to be covered by the present invention, which is defined by the following claims.

I claim:

1. A wheeled board apparatus, comprising:

a platform defining a top standing surface and a bottom surface, said bottom surface bearing at least two primary wheels having their rolling surfaces disposed in line along a central longitudinal axis of said platform;

said platform having a first edge provided axially displaced on one side of said central longitudinal axis, said platform further having a second edge provided axially displaced on a second side of said central longitudinal axis opposite to said first edge, said first and second edges respectively defining first and second concave portions respectively having first and second sidecuts (d);

a first set of at least three outrigger wheels mounted along said first edge, said first set of outrigger wheels having rolling surfaces generally following said first concave portion; and a second set of at least three outrigger wheels mounted along said second edge, said second set of outrigger wheels having rolling surfaces generally following said second concave portion.

2. The wheeled board apparatus according to claim 1, wherein said outrigger wheels disposed along said first and second concave portions do not contact a plane perpendicular to a diameter of one of said primary wheels which is perpendicular to said central longitudinal axis, when a bottom surface of said one primary wheel contacts said plane.

3. The wheeled board apparatus according to claim 2, wherein said primary wheels have a diameter which is greater than that of said outrigger wheels.

4. The wheeled board apparatus according to any of claims 1–3, wherein said sidecuts (d) are at least ½ inch.

5. The wheeled board apparatus according to claim 4, wherein said sidecuts (d) are at least 1 inch.

6. The wheeled board apparatus according to claim 5, wherein said sidecuts (d) are from 1½ to 3 inches.

7. The wheeled board apparatus according to claim 4, comprising at least three primary wheels and having at least four outrigger wheels at each of said first and second edges.

8. The wheeled board apparatus according to claim 7, wherein said outrigger wheels are angled from said platform at an angle ($\alpha$) of from 45°–135°.

9. The wheeled board apparatus of claim 8, wherein said outrigger wheels are angled from said platform at said angle ($\alpha$) wherein $90° \leqq \alpha \leqq 125°$.

10. The wheeled board apparatus of claim 9, wherein said outrigger wheels are angled from said platform at said angle ($\alpha$) wherein $95° \leqq \alpha \leqq 110°$.

11. The wheeled board apparatus of claim 8, wherein said outrigger wheels are angled from said platform at said angle ($\alpha$) wherein $55° \leqq \alpha \leqq 90°$.

12. The wheeled board apparatus of claim 11, wherein said outrigger wheels are angled from said platform at said angle ($\alpha$) wherein $70° \leqq \alpha \leqq 85°$.

13. The wheeled board apparatus according to claim 11, wherein said standing surface has a convex load bearing portion.

14. The wheeled board apparatus according to claim 13, further comprising at least one binding means located on said convex load bearing portion.

15. The wheeled board apparatus according to claim 13, wherein said convex load bearing portion is resiliently deformable.

16. The wheeled board apparatus according to claim 8, wherein said primary wheels have a higher durometer rating than said outrigger wheels.

17. The wheeled board apparatus according to any of claims 1–3, wherein at least one of said primary wheels comprises a truck, said truck having a longitudinal axis which is disposed along said central longitudinal axis of said platform.

* * * * *